United States Patent [19]

Steiner et al.

[11] 4,444,509

[45] Apr. 24, 1984

[54] FEED MIXING APPARATUS

[75] Inventors: Marvin B. Steiner; Roy I. Steiner, both of Orrville, Ohio

[73] Assignee: Sevenson Company, Orrville, Ohio

[21] Appl. No.: 253,307

[22] Filed: Apr. 13, 1981

[51] Int. Cl.[3] ..... B01F 15/02

[52] U.S. Cl. ..... 366/157; 366/186; 366/50

[58] Field of Search ..... 366/131, 132, 133, 135, 366/219, 222, 57, 59, 66, 154, 156, 157, 165, 186, 196, 223, 224, 227, 228, 229, 603, 306, 295, 296, 25, 27, 28, 38, 42, 50, 52, 150, 158, 184, 336, 337, 338, 230, 56, 80, 293

[56] References Cited

U.S. PATENT DOCUMENTS

| | | | |
|---|---|---|---|
| Re. 23320 | 1/1951 | Willard et al. | 366/59 X |
| 761,541 | 5/1904 | Ransome | 366/44 |
| 1,260,840 | 3/1918 | Wege | 366/44 |
| 1,756,390 | 4/1930 | Schneider | 366/44 X |
| 1,861,416 | 5/1932 | Jaeger | 366/44 |
| 1,872,624 | 8/1932 | Eggert | 366/44 |
| 2,006,728 | 7/1935 | Ball | 366/44 |
| 2,522,025 | 9/1950 | Ensman | 34/135 |
| 2,548,733 | 4/1951 | Longenecker | 366/57 |
| 3,358,973 | 12/1967 | Mitchell et al. | 366/50 |
| 3,415,492 | 12/1968 | Rule | 366/157 |
| 3,606,277 | 9/1971 | Kader | 366/50 |
| 3,792,536 | 12/1974 | McGehee | 34/102 |
| 3,897,934 | 8/1975 | Phillips | 366/230 X |
| 4,057,225 | 11/1977 | Feree | 366/224 X |

FOREIGN PATENT DOCUMENTS

| | | | |
|---|---|---|---|
| 1207776 | 7/1958 | France | 366/133 |
| 250568 | 7/1926 | Switzerland | 83/73 |
| 608905 | 5/1978 | U.S.S.R. | 366/50 |

*Primary Examiner*—Harvey C. Hornsby
*Assistant Examiner*—Christine A. Peterson
*Attorney, Agent, or Firm*—Mack D. Cook, II

[57] ABSTRACT

A feed mixing apparatus for use wherever livestock is cared for and fed. The apparatus has a frame positioned by the user adjacent to a supply conveyor for feed constituents and a delivery conveyor for mixed feed. A hopper unit for selectively receiving feed constituents or discharging mixed feed is supported by the frame. A rotatable cylindrical drum with internal spiral mixing and conveying blades is mounted on the frame. The hopper unit is connected to the front of the drum by a cylindrical pipe having front and rear upwardly opening semi-cylindrical segments. An auger shaft extends from the hopper unit and through the pipe into and through the drum axially of the spiral blades. A drive means on the frame provides for unidirectional rotation of the drum so that the spiral blades are always moving feed constituents to the front of the drum. The drive means also provides for selective bidirectional rotation of the auger shaft for moving feed constituents from the hopper unit into the drum or for moving mixed feed from the drum into the hopper unit. Within the drum, paddle elements continuously direct feed constituents or mixed feed onto a rear pipe segment for movement by the auger shaft into or from the drum.

7 Claims, 13 Drawing Figures

FEED MIXING APPARATUS

BACKGROUND OF THE INVENTION

The invention relates to a feed mixing apparatus for use wherever livestock is cared for and fed. A farmer or rancher has an obligation every day of the year to mix and deliver feed for animal consumption. There are also many other daily chores to which to attend. The "feed time" chore must be handled in the shortest possible time at the lowest possible cost, using inexpensive and easily maintained equipment and wasting little of the feed constituents or the mixed feed.

The scope and content of the prior art has been determined. (See, form PTO-1449 in the file wrapper.) The most relevant prior art is: AG, U.S. Pat. No. 3,415,492, 12/1968, Rule; AF, U.S. Pat. No. 3,358,973, 12/1967, Mitchell et al; AA, U.S. Pat. No. 761,541, 5/1904, Ransome; and AC, U.S. Pat. No. 1,861,146, 5/1932, Jaeger.

Rule dealt generally with apparatus for mixing and dispensing feed for animal consumption. He explained the desirability of feeding animals a complete mixed ration of cracked grain, which would include ground cracked grain, protein supplement, minerals, vitamins, feed additives and roughage.

In Rule, the mixing unit 30 includes a cylindrical drum 31 used as the central component of a system of conveyors for receiving feed constituents from storage and dispensing mixed feed for consumption. The mixing unit 30 has an input section 29 and an output section 32 at opposite ends of the rotatable drum 31 which has internal rigidly positioned spiral (continuous or interrupted) blade flights 41. The input section 29 is connected to the drum interior by a cylindrical "boot" or pipe 33. An auger drive shaft 37 extends from the input section 29 through the pipe 33 into and through the drum 31 axially of the spiral blades 41. Within the input section 29, the auger flighting 38 has an effective diameter equivalent to the internal diameter of the pipe 33. Within the drum 31, the auger flighting 40 has a greater efective diameter; a radial depth such that there is approximately a two-inch clearance, represented at 42, between the outer edge of the auger flighting and the edges of the spiral blades 41.

The Rule concept is that the rotating auger flighting 40 will move the feed constituents lengthwise in the mixing drum 31 in the direction from the intake end toward the output section 32. The operation of the oppositely rotating spiral blades 41 is not to convey the feed constituents lengthwise within the drum; but rather, to "pick up the grain or heavier more seperable particles and lift them to the top of the drum whereupon they again drop onto the materials carried by auger flighting 40, which are continuously involved or more so with the lighter and more bulky materials such as chopped ensilage or hay." Rule, col. 4, 11. 47–52.

To the person of ordinary skill in the art of feed mixing, it is apparent that the compromise between a shearing and moving action for the auger 40 and spiral blade 41 components of Rule, the optimum 2-inch clearance, requires an extremely high power input using large amounts of energy. Also, the length of the drum is relatively long. Further, unmixed feed components from the output section 32 falls onto the wagon 10 and are put through the mixing drum again—"As a general rule, the load of unmixed feed components is put through $1\frac{1}{3}$ times." Col. 6, 11. 18 and 19.

Mitchell et al discloses a portable mixing apparatus, for accurately mixing two or more dry materials with one or more liquids. The apparatus has a frame 10 with rollers 13 to rotatably support the mixing drum 14. As in Rule, the mixing action is "pass-through."

Ransome discloses (FIG. 3) a rotatable cylindrical drum with dual internal spiral mixing and conveying blades mounted on a frame.

Jaeger discloses a rotatable mixing drum with an auger shaft positioned axially of spiral blades.

The above discussed prior art all deal generally with the problems encountered in "mixing" and present solutions therefor. It has now been found that feed mixing apparatus may be portable, efficient, inexpensive to acquire and to operate, and easy to maintain.

SUMMARY OF THE INVENTION

The object of the invention is to provide a portable, efficient, inexpensive to acquire and to operate, and easy to maintain feed mixing apparatus; an apparatus comprising a combination of elements for use wherever livestock is cared for and fed, by farmer or rancher.

The present invention was conceived because the farm and rach segments of the agricultural economy were not being supplied with the right combination of equipment for feed mixing. Storage silos and grain bins present no problem. Pipe troughs and conveyors are readily available. What has not been available is a feed mixing apparatus possessing the inherent advantages of the present invention—portability, efficiency, cost and maintenance.

These and other objects of the invention, as well as the operating advantages thereof, will be apparent in view of the following drawings and specification.

Generally described, a mixing apparatus for livestock feed constituents embodying the invention has a frame. A cylindrical drum with front and rear walls and internal spiral mixing and conveying blades is rotatably mounted on the frame. The front wall of the drum has an axial opening. A funnel-shaped hopper unit is supported on the front of the fame for receiving unmixed feed constituents. The hopper unit has an opening for moving the feed constituents toward the interior of the drum for mixing therein.

According to the invention, the generally described feed mixing apparatus is improved in that the feed constituents move from the opening in the hopper unit into an upwardly opening semi-cylindrical front segment of a feed pipe extending into the drum through the axial opening in the drum front wall as a fully cylindrical medial sleeve segment. The feed pipe terminates within the drum in an upwardly opening semi-cylindrical rear segment. The rear feed pipe segment directs feed constituents toward the rear wall of the drum and is open to receive mixed feed for discharge from the drum. The hopper unit further has an opening adjacent the front feed pipe segment for discharging mixed feed toward a delivery point.

Further according to the invention, a rotatable feeder screw auger shaft (as distinguished from an intromitter in the form of a helical spiral) extends from the front feed pipe segment and through the medial sleeve segment and over the rear feed pipe segment and through the drum axially of the spiral mixing and conveying blades.

Still further according to the invention, a drive means is mounted on the frame for selective rotation of the drum and the feeder screw auger shaft. The drive means has components to provide a unidirectional rotational movement for the drum so that either feed constituents or mixed feed will always be moving toward said rear feed pipe segment. The drive means also has components to provide a bidirectional rotational movement for the feeder screw auger shaft so that the feed constituents will be moving from the hopper unit and into a rotating drum, or, so that mixed feed will be moving from the rear feed pipe segment and a rotating drum into the front feed pipe segment and through the opening in the hopper unit for discharging mixed feed toward a delivery point.

THE DRAWINGS

Figure 9A:
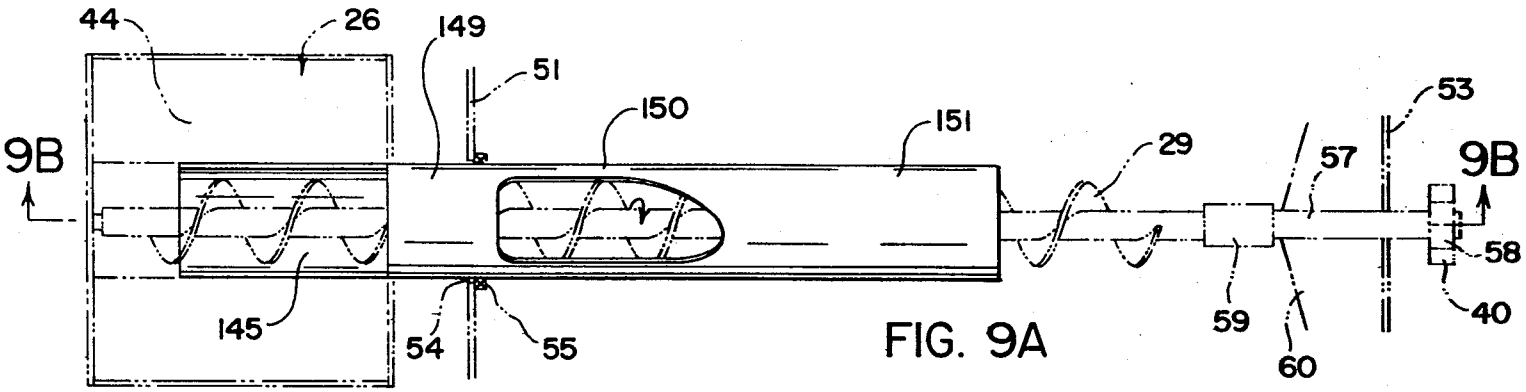
Figure 9B:
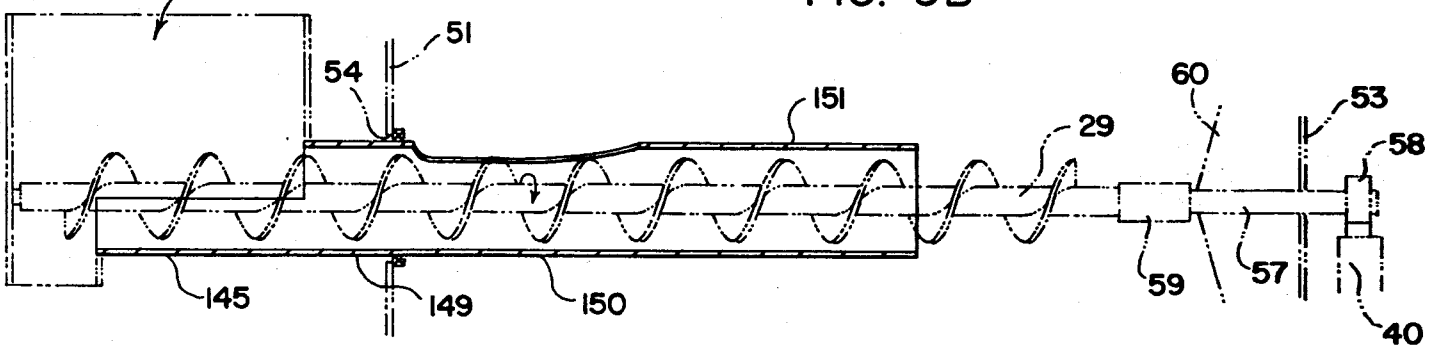

FIGS. 9A and B are plan and elevational views showing an additional embodiment of a feed mixing apparatus according to the invention.

DETAILED DESCRIPTION OF THE INVENTION

A feed mixing apparatus according to the invention is referred to generally by the numeral 20. The function and purpose of an apparatus 20 is to mix and discharge various feed constituents 21 for animal consumption. The feed constituents 21 are selectively delivered to the apparatus 20 as by a supply conveyor 22. After mixing by the apparatus 20, the mixed feed 23 is taken away as by a delivery conveyor 24.

A feed mixer 20 has five primary or basic components. A floor or ground mounted generally rectangular and portable frame 25 is positioned by the user adjacent to the conveyors 22 and 24. The front of the frame 25 supports a hopper unit 26 for receiving the feed constituents 21 from the supply conveyor 22 and discharging the mixed feed 23 onto the delivery conveyor 24. The medial portion of the frame 25 rotatably mounts a cylindrical drum 27 with internal spiral mixing and conveying blades 28. A feeder screw auger preferably of uniform or constant diameter shaft 29 extends from the front wall of the hopper unit 26 and through the drum 27 axially of the spiral blades 28. The front of the frame 25 also mounts a drive means 30 for selective rotation of the drum 27 and spiral blades 28 and the auger shaft 29.

The function of the primary components of an apparatus 20—the frame 25, the hopper unit 26, the cylindrical drum 27 with spiral blades 28, the auger shaft 29 and the drive means 30—for the mixing of feed constituents 21 to produce a mixed feed 23 will be understood by reference to FIGS. 8A through D.

The feed constituents 21 for livestock may be many and varied as required not only for maintenance of health but also for achievement of optimal growth rates. For example, a batch of mixed feed 23 could comprise: nutrients 21A, such as protein supplement, minerals, vitamins and feed additives, 10% by weight; hay or roughage 21B, 30% by weight; and, corn or ground cracked grain 21C, 60% by weight.

To properly use the apparatus 20, it has been found desirable to add the feed constituents 21 in the sequence of the lowest percentage first—21A then 21B then 21C. Also, the optimum mixing efficiency is realized when the volume of the feed constituents 21 is about 70% of the cubic capacity of the cylindrical drum 27.

Figure 8A:
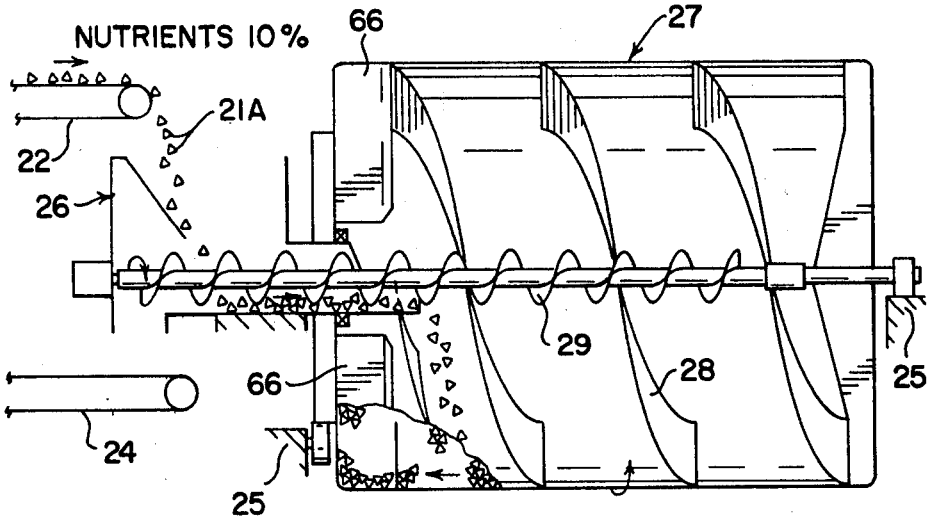

FIG. 8A depicts the supply of nutrients 21A (shown as small triangles) from conveyor 22 into the hopper unit 26. The nutrients 21A are carried into the rotating drum 27 by the rotating auger shaft 29.

Figure 8B:
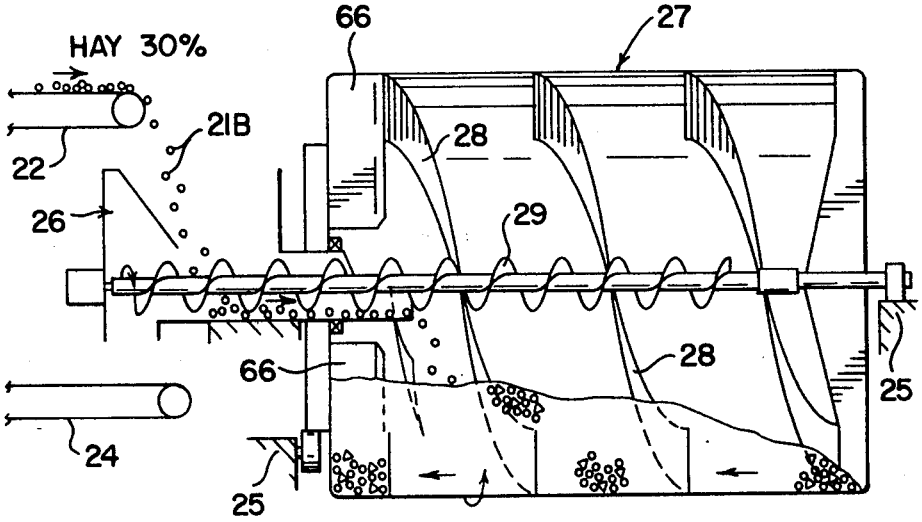

FIG. 8B depicts the supply of hay 21B (shown as small circles) from conveyor 22 into the hopper unit 26. The hay 21B is carried into the rotating drum 27 by the rotating auger shaft 29 for mixing with the nutrients 21A by the spiral blades 28.

Figure 8C:
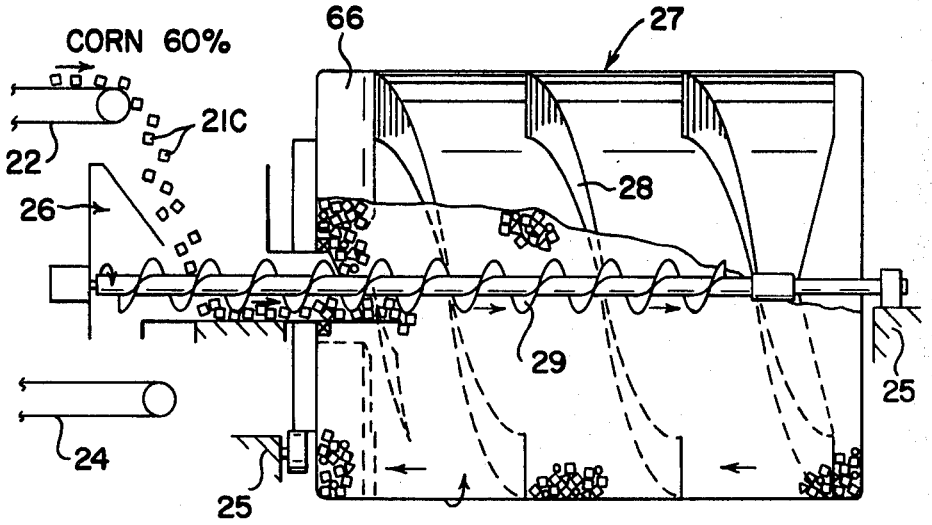

FIG. 8C depicts the supply of corn 21C (shown as small cubes) from conveyor 22 into the hopper unit 26. The corn 21C is carried into the rotating drum 27 by the rotating auger shaft 29 and is mixed with the nutrients 21A and the hay 21B by both the spiral blades 28 and the auger shaft 29 to make up the mixed feed 23.

Figure 8D:
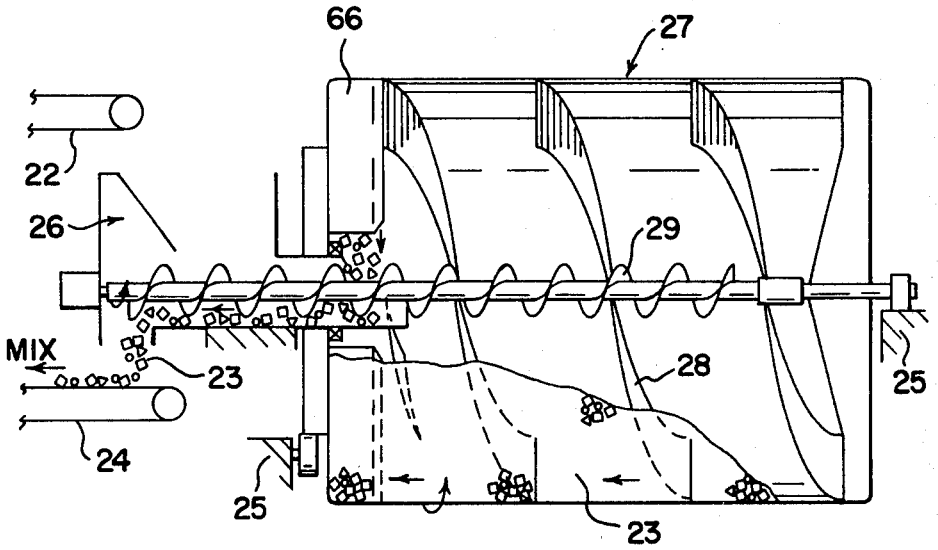

FIG. 8D depicts the condition of the apparatus 20 during dispensing of the fully mixed feed 23. The drum 27 continues to rotate in the same direction. Reversal of the direction of rotation of the auger shaft 29 will discharge the mixed feed 23 back into the hopper unit 26 and through an opening therein (hereinafter described) onto the delivery conveyor 24.

THE FRAME 25

The rectangular frame 25 is fabricated as a weldment and may comprise a front base lintel 31 connected by two side channels 32 to a rear box beam 33. The base lintel 31 mounts two box channels 34 for rotatably positioning two drum support rollers 35 concentric to the rotational axis of the cylindrical drum 27. Between the box channels 34, the base lintel 31 also mounts a vertically oriented stanchion pipe 36 for positioning and attachment of the hopper unit 26. The stanchion pipe 36 may be sealed at both ends as by the upper and lower plates 37, to provide a sump or reservoir when hydraulic fluid is used to actuate components of the drive means 30.

The front right-hand corner of the frame 25 has a platform 38 for mounting a drive motor and a pump for supplying hydraulic fluid under pressure to components of the drive means 30. The front right side of the frame 25 has two laterally extending brackets 39 for mounting components of the drive means 30. The rear of the frame 25 has a pedestal 40 for bearing block mounting of the rear of the drum 27.

THE HOPPER UNIT 26

The hopper unit 26 is fabricated as a weldment and has two base flanges 41 for mounting on and connection to the stanchion pipe 36 and upper plate 37 elements of the frame 25.

The funnel-shaped receptacle of the hopper unit 26, formed by interconnected front and rear vertical end walls, 42 and 43, and two converging side walls 44, moves feed constituents 21 from a conveyor 22 into an interconnected upwardly opening semi-cylindrical front segment 45 of a length of horizontally oriented tubing or pipe.

The hopper front wall 42 carries a vertical plate 46 for mounting a hydraulic motor component of the drive means 30. The drive shaft of this motor extends through the plate 46 for connection to the front end of the rotatable auger shaft 29. Behind the front wall 42 and adjacent the front segment 45 of the feed pipe, the hopper unit has a square opening 47 for discharge of mixed feed 23 onto a delivery conveyor 24.

Figure 5:
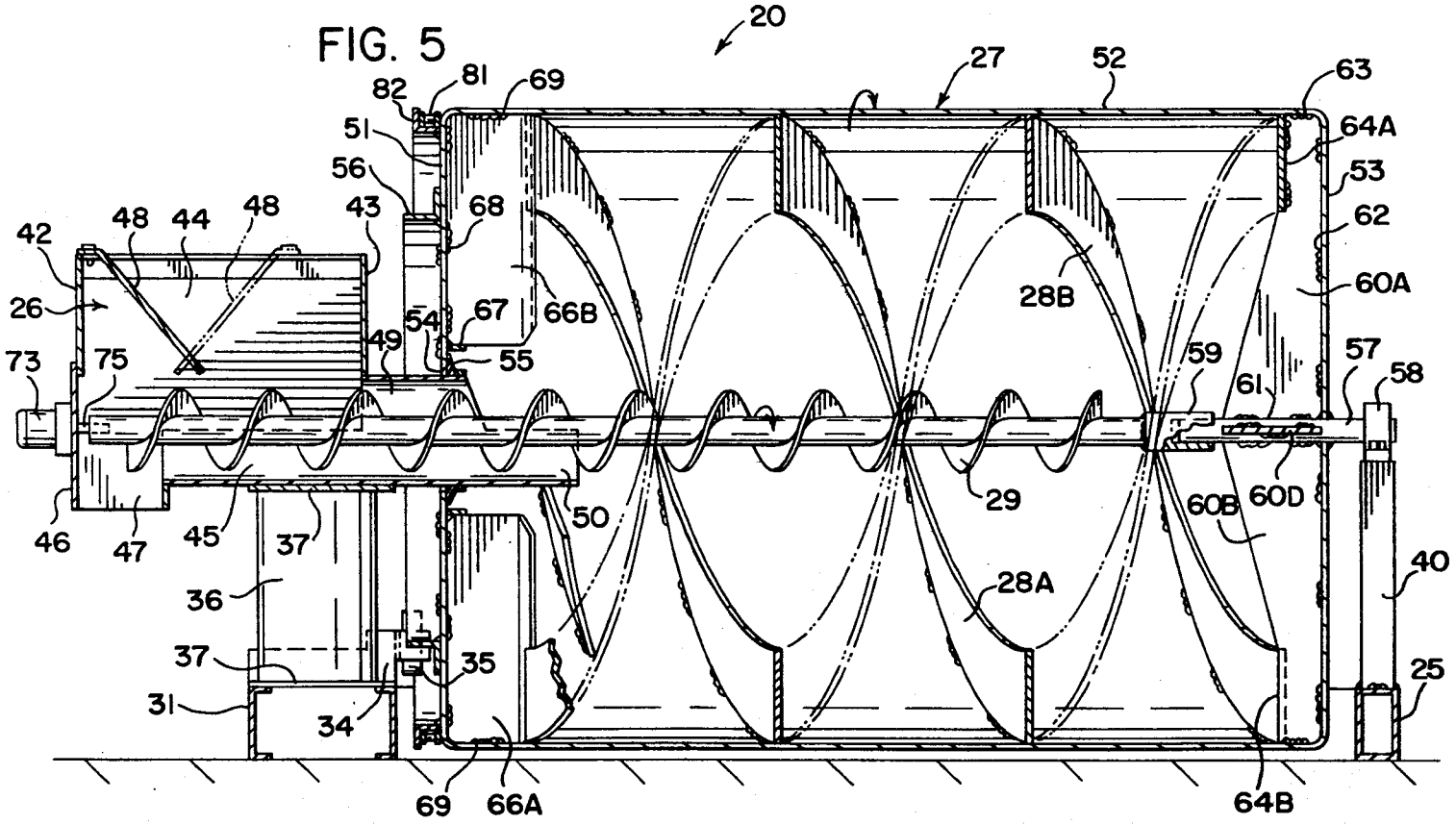
FIG. 5 is a side elevation in section, taken substantially as indicated on line 5—5 of FIG. 3, showing structural details of the feed mixer.

The hopper unit 26 also has a movable deflector plate 48 with guide pins insertable into mounting holes at predetermined positions on the top flange of the side walls 44. As shown by the full lines in FIG. 5, the deflector plate 48 may be positioned between the side walls 44 to direct the input flow of various feed constituents 21 onto the auger shaft 29 for movement into the cylindrical drum 27. If it is desired to bypass the mixing of feed constituents 21, the deflector plate 48 may be positioned as shown by the chain lines in FIG. 5 to direct the input flow of selected feed constituents 21 from a conveyor 22 through the hopper unit 26 and the opening 47 onto a delivery conveyor 24.

Below and behind the hopper unit rear wall 43, the pipe is fully cylindrical to provide a medial sleeve segment 49 for insertion through an axial opening in the front wall of a drum 27. The rear pipe segment 50 is upwardly opening and semi-cylindrical for a cooperative relationship with interior elements of the drum 27 (hereinafter described), the spiral blades 28 and the auger shaft 29.

THE DRUM 27

The drum 27 is fabricated as a weldment and may comprise a front wall 51 connected by a cylindrical side wall 52 to a rear wall 53 and interior elements including the spiral mixing and conveying blades 28.

The front wall 51 of the drum 27 has an axial opening 54 to receive the medial and rear pipe segments 49 and 50 of the hopper unit 26. A resilient L-shaped annular element 55 may be fitted around the medial pipe segment 49 and against the inner face of the drum wall 51 to mechanically seal the axial opening 54 (see FIG. 5). The outer face of the drum wall 51 carries an annular track ring 56 positioned concentrically around the drum opening 54. The track ring 56 engages the two support rollers 35 on the frame 26 to rotatably mount the front of the drum 27.

The rear wall 53 of the drum 27 has an interconnected axial shaft 57 extending therethrough. The outer end of shaft 57 is rotatably mounted in a bearing block 58 carried by the frame pedestal 40. The inner end of shaft 57 is inserted into a journal sleeve 59 carried on the rear end of the rotatable auger shaft 29.

The medial portion of the drum shaft 57 provides the axial component for a series of radial ribs 60. As shown (see FIGS. 5 and 6), four equally spaced rib elements, 60A–D, have radially inner ends connected, as at 61, to the shaft 57. The outwardly directed edge of each rib element, 60A–D, conforms to the inner face of the rear drum wall 53 and is connected thereto, as at 62. Also, the radially outer end of each rib element, 60A–D, may be connected to the drum side wall 52, as at 63. Together, the ribs 60A–D provide a structure which strengthens the shaft 57 and strengthens the rear of the drum 27. Two opposed ribs, 60A and B, also provide an attachment point for the rear end of the blades 28 which are continuously connected to the inner surface of the drum side wall 52.

Figure 6:
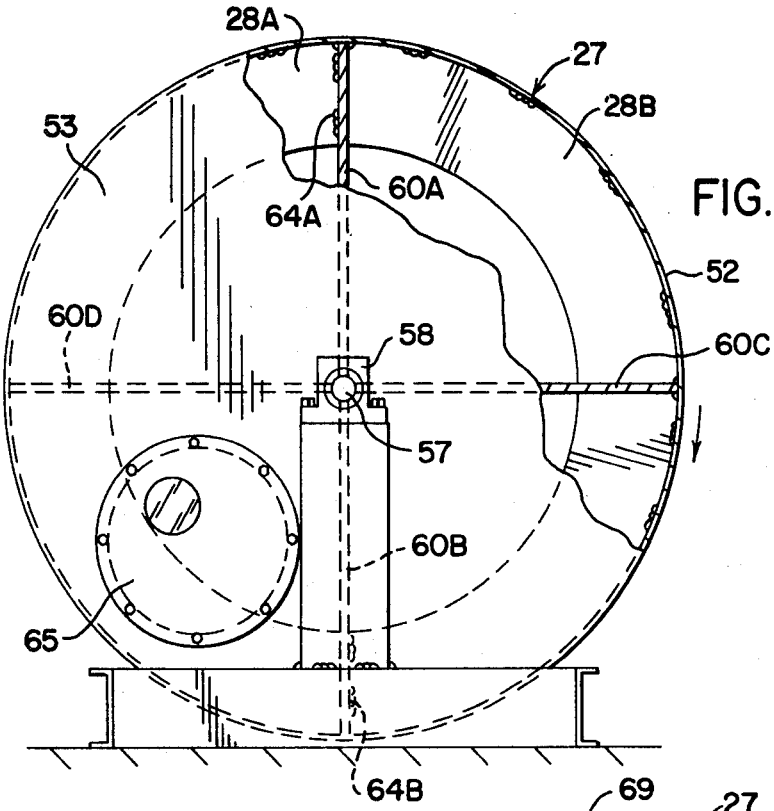
FIG. 6 is an end view of the rear of the feed mixer, taken substantially as indicated on line 6—6 of FIG. 2.

In the embodiment of a feed mixer 20 herein disclosed, there are two continuous flights of the spiral mixing and conveying blades, 28A and B, extending through the drum 27 coaxially around the auger shaft 29. As best shown in FIG. 6, the rear end of blade flight 28A is connected to a conforming inwardly directed edge of a radial rib 60A, as at 64A. Also, the rear end of blade flight 28B is connected to a conforming inwardly directed edge of a radial rib 60B, as at 64B. Referring still to FIG. 6, the rear drum wall 53 may have an inspection port 65, opening between two of the radial ribs, 60B and D, providing access to the interior of the drum 27 as required for maintenance and cleaning.

The inner face of the front drum wall 51 carries a series of radial paddles 66 positioned around the drum opening 54. The paddles 66 function to sequentially and continuously direct feed constituents 21 or mixed feed 23, conveyed by the spiral blades 28, onto the upwardly opening semi-cylindrical rear pipe segment 50 for movement by a rotating auger shaft 29 into or from the interior of a rotating drum 27. As shown (see FIGS. 5 and 7), four equally spaced paddle elements, 66A–D, have radially inner ends connected to a flange ring 67 positioned around the mechanical seal element 55. The outwardly directed edge of each paddle element, 66A–D, conforms to the inner face of the front drum wall 51 and is connected thereto, as at 68. Also, the radially outer end of each paddle element 66 may be connected to the drum side wall 52, as at 69. Two opposed paddles 66A and B, provide an attachment point for connection to the front end of blade flights, 28A and B, as at 70A and B.

Figure 7:
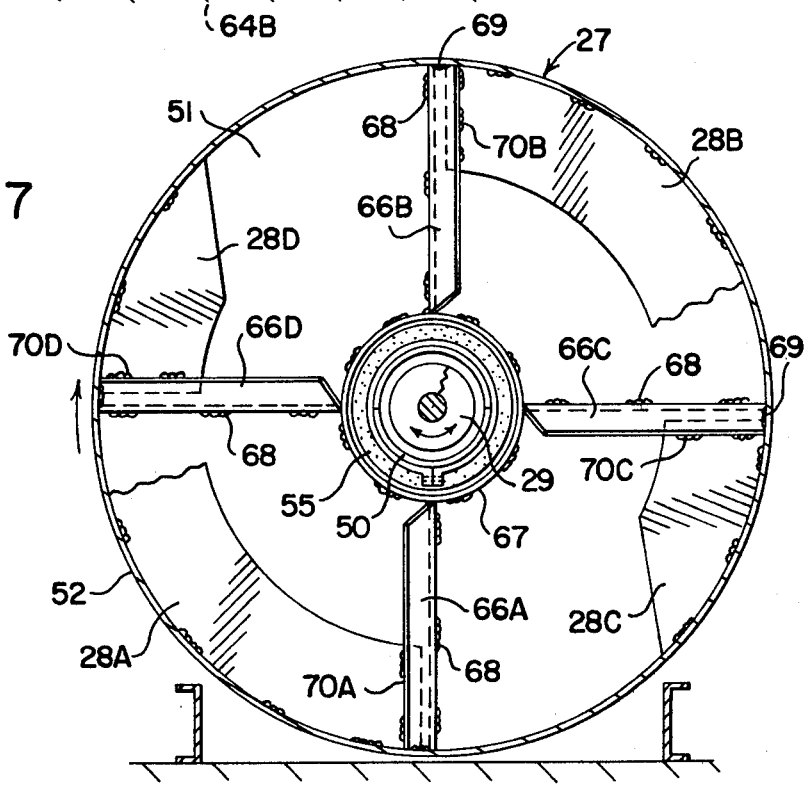
FIG. 7 is a cross-section, taken substantially as indicated on line 7—7 of FIG. 2; and, FIGS. 8A–D are schematic sequential views showing the cooperative relationship of the components of the feed mixer.

In the embodiment of a feed mixer 20 herein disclosed, the forward conveying action of the two continuous spiral blade flights, 28A and B, is augmented by two interposed short blade flights, 28C and D. As best shown in FIG. 7, two opposed paddles, 66C and D, provide an attachment point for connection of the leading end of blade flights, 28C and D, as at 70C and D.

THE DRIVE MEANS 30

The drive means 30 is a combination of various components, as shown, including conventional piping and valving, not shown. Together, these components will provide for variable speed rotational movement of the cylindrical drum 27 and the auger shaft 29 during operational use of the feed mixer 20. Certain of these components are intended to provide a unidirectional rotational movement for the drum 27 so that the spiral mixing and conveying blades, 28A and B, therein will always be moving the feed constituents 21 or mixed feed 23 toward the axial drum opening 54, the drum paddles 66A–D, and the semi-cylindrical pipe segment 50 of the hopper unit 26. Others of these components are intended to provide a bidirectional rotational movement for the auger shaft 29 so that the feed constituents 21 will be moving from the hopper unit 26 into the interior of the rotating drum 27, or, so that the mixed feed 23 will be moving from the interior of the rotating drum 27 into the hopper unit 26.

An electric motor 71 mounted on the frame platform 38 will drive a hydraulic pump 72. The pump 72 is supplied from a sump or reservoir for hydraulic fluid, such as the sealed stanchion pipe 36 on the frame 25. The pump 72 supplies fluid under pressure to two hydraulic drive motors, 73 and 74.

Hydraulic drive motor 73 is mounted on the hopper unit vertical plate 46 and has a drive shaft 75 for connection to the front end of the auger shaft 29.

Hydraulic drive motor 74 is mounted on a floating bracket 76 having a laterally directed counterweight arm 77. The motor 74 has a horizontally extending elongated drive shaft 78. The drive shaft 78 is journalled in twin bearing blocks 79 carried by the frame brackets 39. Between the bearings 79, the drive shaft 78 carries and is connected to a drive sprocket 80.

The teeth of drive sprocket 80 engage the links of a continuous length of drive chain 81. The drive chain 81 is trained around an annular drive ring 82. The drive ring 82 is carried on the outer face of the drum wall 51 and positioned concentrically around the drum track ring 56. The drive chain 81 engages a series of radially directed drive studs 83 inserted through and projecting radially of the drive ring 82.

Figure 1:
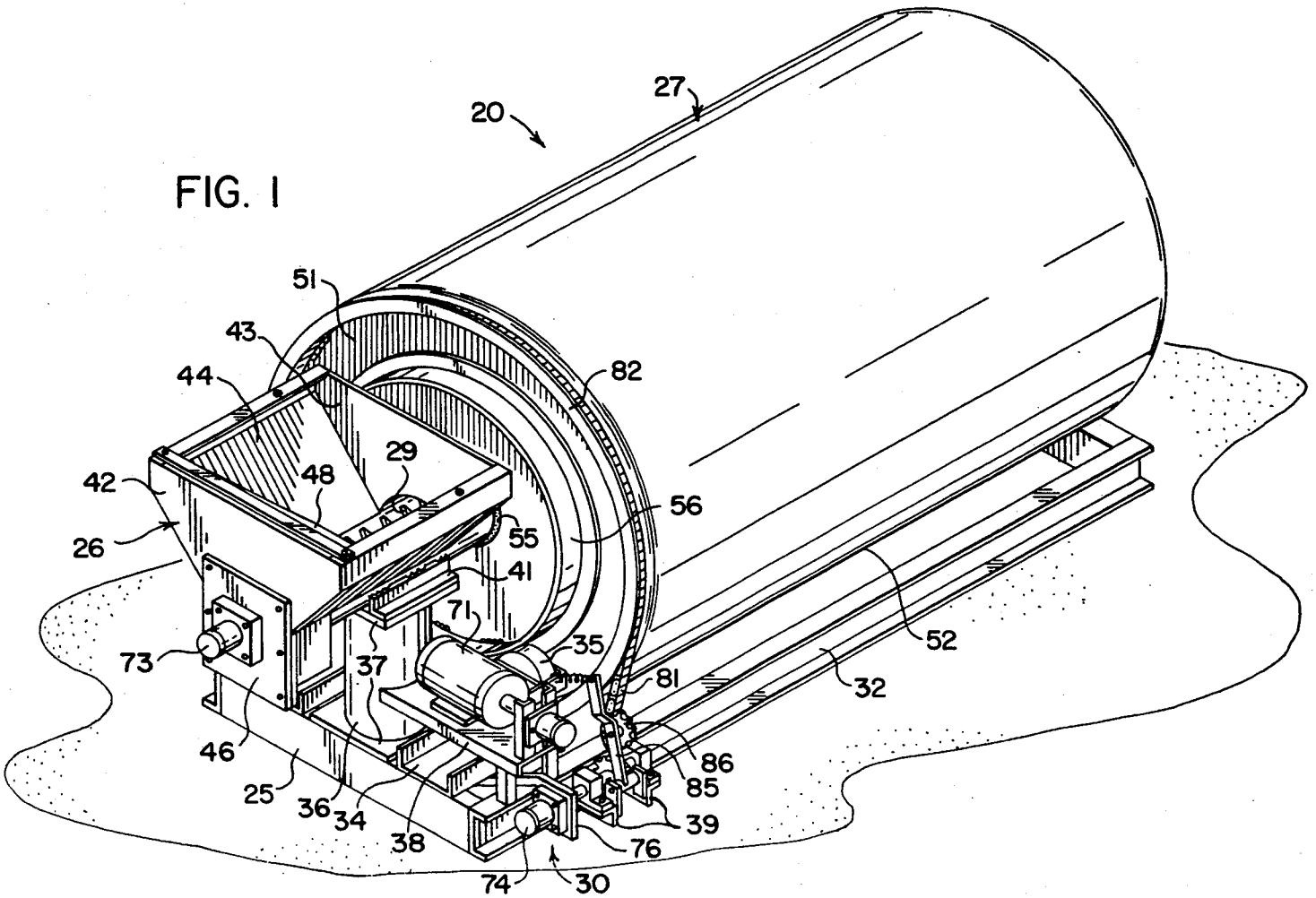
FIG. 1 is an isometric view of a feed mixing apparatus according to the invention.
Figure 2:
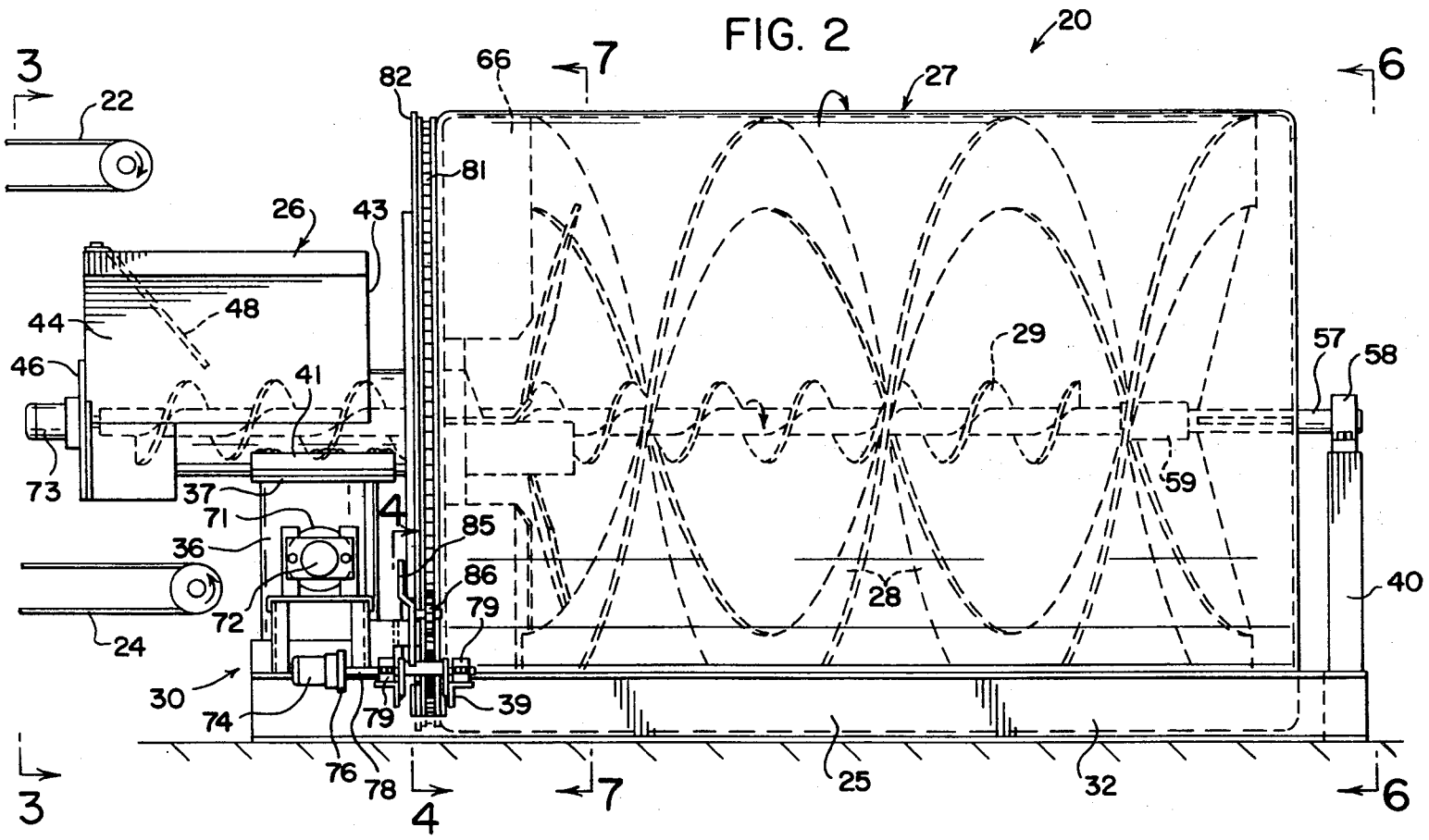
FIG. 2 is a side elevation of the feed mixing apparatus, positioned adjacent to a supply conveyor for feed constituents and a delivery conveyor for mixed feed.
Figure 3:
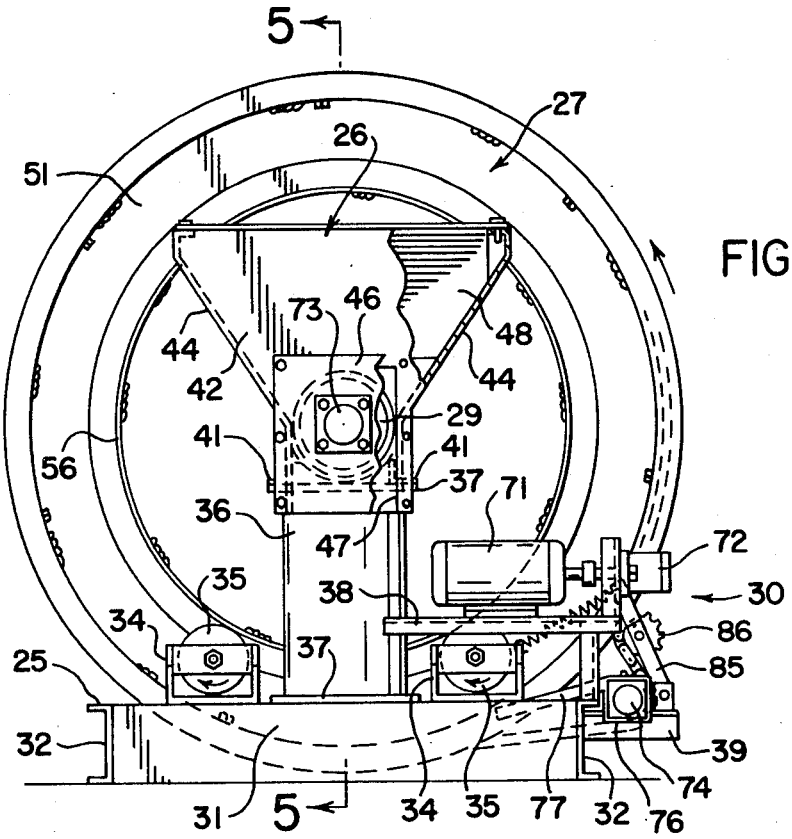
FIG. 3 is an end view of the front of the feed mixer, taken substantially as indicated on line 3—3 of FIG. 2.
Figure 4:
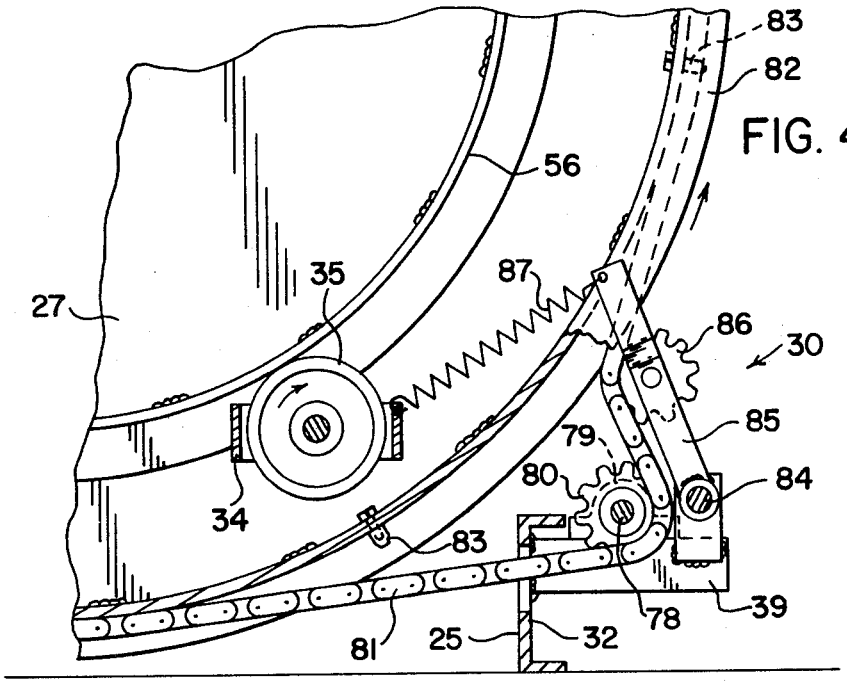
FIG. 4 is an enlarged fragmentary view of the front of the feed mixer, showing details of drive means components to provide unidirectional rotational movement for a drum.

The drive means 30 may also include an assembly of mechanical components for maintaining tension on the drive chain 81. As best shown in FIG. 4, outwardly of the bearings 79, the frame brackets 39 carry a fixed cross-shaft 84. The cross-shaft 84 movably mounts an upwardly extending idler arm 85. The medial portion of the arm 85 carries an idler sprocket 86 positioned for engagement with the links of the drive chain 81. The upper end of arm 85 is an attachment point for an end of a tension spring 87. The other end of spring 87 is attached to an adjacent frame channel 34. The action of the spring 87 is to bias the arm 85 and maintain the sprocket 86 in tensioning engagement with the drive chain 81.

As shown, the drive means 30 uses an electric motor 71 to actuate the hydraulic pump 72 and the hydraulic drive motors 73 and 74. In the alternative, the drive shafts 75 and 78 could be powered by direct connected internal combustion engines, or, by an electric motor or an internal combustion engine through a mechanical transmission assembly.

ADDITIONAL EMBODIMENT

The following Specification relates to an additional or further embodiment of a feed mixing apparatus according to the invention.

BACKGROUND OF THE ADDITIONAL EMBODIMENT

Subsequent to conception of the feed mixing apparatus 20, several replications thereof have been made and delivered for use by farmers to mix and deliver feed for animal consumption. These farmers had been advised that optimum mixing efficiency is realized when the volume of feed constituents 21 is about 70% of the cubic capacity of the cylindrical drum 27. Some users of the feed mixer 20 have reported that the mixing of the nutrients 21A, hay 21B and corn 21C, to produce a mixed feed 23, was nonuniform or incomplete.

The inventors undertook to investigate these complaints about the operating efficiency of the feed mixer 20. It became apparent to the inventors that some users of the feed mixer were loading the drum 27 with feed constituents 21 to as much as 95% of the cubic capacity; were using a higher percentage (greater than 30% by weight) of hay or roughage (or ensilage); or both.

The additional embodiment hereinafter disclosed is the solution of the inventors to the problems encountered when the user of a feed mixer 20 adds feed constituents 21 in a total volume in excess of about 70% of the cubic capacity of the cylindrical drum 27; adds a percentage of hay 21B in excess of 30%; or both.

SUMMARY OF THE ADDITIONAL EMBODIMENT

The object of the additional embodiment is to provide a feed mixing apparatus according to the invention which will enable the user: to add feed constituents in a total volume of from 70% to 95% of the cubic capacity of the drum; to use more than 30% by weight of hay or roughage (or ensilage); or both.

The hopper unit pipe of the preferred embodiment has an upwardly opening semi-cylindrical front segment, a fully cylindrical medial sleeve segment and an upwardly opening semi-cylindrical rear segment. According to the invention, the hopper unit pipe of the additional embodiment has a fully cylindrical terminal segment, extending beyond the rear segment to coaxially enclose and hood the rotatable auger shaft, so that feed constituents are moved into the rear portion of the cylindrical drum.

DETAILED DESCRIPTION OF ADDITIONAL EMBODIMENT

Referring to FIGS. 9A and B, the hopper unit 26, the auger shaft 29, the frame pedestal 40, the drum front and rear walls 51 and 53, the annular seal element 55, the drum shaft 57 and bearing block 58 and journal sleeve 59, and the radial ribs 60 are shown in chain lines.

The hopper unit pipe has an upwardly opening semi-cylindrical front segment 145 interconnected with the side walls 44. The front segment 145 interconnects with a fully cylindrical sleeve segment 149 for insertion through the axial opening 54 in the drum front wall 51. The sleeve segment 149 interconnects with an upwardly opening semi-cylindrical rear segment 150. The rear segment 150 interconnects with a fully cylindrical terminal segment 151. The terminal segment 151 extends beyond the rear segment 150 to coaxially enclose the auger shaft 29 so that feed constituents 21 are moved into the rear portion of the drum 27.

What is claimed is:

1. In a mixing apparatus for livestock feed constituents having a frame, a cylindrical drum with front and rear walls and internal spiral mixing and conveying blades rotatably mounted on said frame, the front wall of said drum having an axial opening, and a funnel-shaped hopper unit supported on the front of said frame for receiving unmixed feed constituents and having an opening for moving said feed constituents toward the interior of said drum for mixing therein, the improvements wherein:

said feed constituents move from said opening in said hopper unit into an upwardly opening semi-cylindrical front segment of a feed pipe extending into said drum through said axial opening in the drum front wall as a fully cylindrical medial sleeve segment and terminating within said drum in an upwardly opening semi-cylindrical rear segment, said rear feed pipe segment directing feed constituents toward the rear wall of said drum and being opened to receive mixed feed for discharge from said drum, said hopper unit further having an opening adjacent said front feed pipe segment for discharging mixed feed toward a delivery point;

a rotatable feeder screw auger shaft extends from said front feed pipe segment and through said medial sleeve segment and over said rear feed pipe segment and through said drum axially of said spiral mixing and conveying blades; and, a drive means is mounted on said frame for selective rotation of said drum and said feeder screw auger shaft, said drive means having components to provide a unidirectional rotational movement for said drum so that either feed constituents or mixed feed will always be moving toward said rear feed pipe segment, said drive means also having components to provide a bidirectional rotational movement for said feeder screw auger shaft so that feed constituents will be moving from said hopper unit and into said rotating drum, or, so that mixed feed will be moving from said rear feed pipe segment and said rotating drum into said front feed pipe segment and through said opening in the hopper unit for discharging mixed feed toward a delivery point.

2. A mixing apparatus according to claim 1, wherein the inner face of the front drum wall carries thereon a series of radial paddles positioned around said axial opening, said paddles functioning to sequentially and continuously direct either feed constituents or mixed feed, conveyed by said spiral mixing and conveying blades, onto said rear feed pipe segment for movement by said rotating feeder screw auger shaft either into or from the interior of said rotating drum.

3. A mixing apparatus according to claim 1 wherein said hopper unit has a movable deflector plate, selectively positioned either to direct feed constituents onto said feeder screw auger shaft for movement in said rotating drum, or, to direct feed constituents through said hopper unit and into said opening adjacent said front feed pipe segment.

4. A mixing apparatus according to claim 1, wherein a resilient annular element is fitted around said medial sleeve segment of the hopper unit pipe and against said inner face of the front drum wall to mechanically seal said axial opening in the front drum wall.

5. A mixing apparatus according to claim 2, wherein the cylindrical drum has two flights of said spiral mixing and conveying blades extending through the drum coaxially around said auger shaft, the inner face of the rear wall of said drum carrying a series of radial ribs, the rear end of each said blade flight being connected to opposed radial ribs, the forward end of each said blade flight being connected to opposed radial paddles carried on said inner face of the front drum wall.

6. A mixing apparatus according to claim 5, wherein the conveying action of said two spiral blade flights is augmented by two interposed short blade flights, said short blade flights being connected to opposed radial paddles carried on said inner face of the front drum wall.

7. A mixing apparatus according to claim 1, wherein said feed pipe also has a fully cylindrical terminal segment extending beyond said upwardly opening semicylindrical rear segment to coaxially enclose and hood said rotatable auger shaft, so that feed constituents are moved into the rear portion of said drum.

* * * * *

UNITED STATES PATENT AND TRADEMARK OFFICE

CERTIFICATE OF CORRECTION

PATENT NO. : 4,444,509

DATED : Apr. 24, 1984

INVENTOR(S) : Marvin B. Steiner and Roy I. Steiner

It is certified that error appears in the above-identified patent and that said Letters Patent are hereby corrected as shown below:

Col. 2, line 41, "of the fame" should read --of the frame--;

Col. 3, line 59, after "feeder screw auger" add --shaft--;

Col. 3, line 60, after "constant diameter" delete --shaft--;

In the Claims, amend Claim 4 to read

--4. A mixing apparatus according to claim 1, wherein a resilient annular element is fitted around a medial sleeve segment of said feed pipe between said front and rear pipe segments and against the inner face of said front drum wall to mechanically seal said axial opening in the front drum wall.--

Signed and Sealed this

*Twenty-first* Day of *August 1984*

[SEAL]

*Attest:*

GERALD J. MOSSINGHOFF

*Attesting Officer*

*Commissioner of Patents and Trademarks*